United States Patent [19]

Diamant et al.

[11] Patent Number: 4,891,886

[45] Date of Patent: Jan. 9, 1990

[54] INSTRUMENT FOR PRESSING ITEMS OUT OF STORAGE SPACES

[76] Inventors: Marcus Diamant, Kungsgatan 1, S-302 45 Halmstad, Sweden; Bertil Diamant; Peder M. Diamant, both of Ellevadsveg 6, DK-2920 Charlottenlund, Denmark

[21] Appl. No.: 75,613

[22] Filed: Jul. 20, 1987

[30] Foreign Application Priority Data

Jul. 24, 1986 [SE] Sweden ..... 8603201
Dec. 1, 1986 [SE] Sweden ..... 8605130

[51] Int. Cl.[4] ..... B26F 1/00

[52] U.S. Cl. ..... 30/363; 294/99.2; 30/364; 81/423

[58] Field of Search ..... 221/25, 30, 31; 294/99.2, 902; 81/421–423, 424.5, 426; 100/234, 235; 30/363, 364

[56] References Cited

U.S. PATENT DOCUMENTS 846,304 3/1907 Hardy ..... 30/364
1,110,528 9/1914 Borrensen ..... 30/364 X
2,191,382 2/1940 Acrt ..... 30/363
3,015,161 1/1962 Semler et al. ..... 30/363
4,257,135 3/1981 Moebius ..... 81/423 X
4,627,432 12/1986 Newell et al. ..... 221/30 X

*Primary Examiner*—D. S. Meislin
*Attorney, Agent, or Firm*—Ostrolenk, Faber, Gerb & Soffen

[57] ABSTRACT

An instrument for pressing items out of receptacles in a storage card, the card having open topped recesses which are closed by a burstable foil layer. The instrument includes a pair of arms which are held together in scissor fashion or by a resilient connection at their ends. One arm has a flat face protruding collet jaw. The other arm carries a counter member having an annular through hole or receptacle for receiving the collet and the item pressed from the card when the collet is pressed against the closed end of the recess and toward the counter member. The counter member supported on its arm may have a plurality of different size receptacles, and the base of each receptacle may be defined by the arm on which the counter member is supported. Also, the counter member on the arm may be replaceable with another counter member.

2 Claims, 2 Drawing Sheets

INSTRUMENT FOR PRESSING ITEMS OUT OF STORAGE SPACES

BACKGROUND OF THE INVENTION

The present invention relates to an instrument for pressing objects out of storage spaces, and particularly for pressing tablets, capsules, and the like items from multiple-pack cards. Those cards generally consist of a sheet of plastic with a number of recesses which serve as storage spaces for the items and a burstable covering over the recesses, such as a foil layer. The invention is described here with reference to pharmaceutical packs, but it is, of course, not limited to that use.

To an increasing extent, pharmaceuticals, health and diet preparations, etc. in the form of tablets, capsules, and the like items are packaged in a card consisting of a sheet of flexible plastic or paper with recesses formed for individual items. After the recesses are filled, they are hermetically sealed with a foil covering layer. The aim of this package construction is to enable individual items to be pressed out of their recesses through the foil. These packages have many advantages over conventional bottles, jars, and the like containers in which items, such as drug tablets, have been loosely packaged.

However, the handicapped or elderly may have difficulty in pressing out drug tablets, or like items, from the foil covered recesses, as the force required to burst the foil layer may be too large. Furthermore, coordination of the user's fingers and of both of his hands is required to release the item and to retrieve the item pressed out. Such coordination is often reduced among the elderly and among certain groups of patients, such as those suffering from rheumatism and those who are neurologically handicapped.

SUMMARY OF THE INVENTION

The object of the present invention is to eliminate the above-mentioned drawbacks and to provide an instrument, of the type described in the background hereof, which in a simple and hygienic manner facilitates pressing items out of their storage recesses in a support pack or card.

This object is achieved with the instrument according to the invention, which includes two arms, connected together, that support respective tools which can be brought together over one item holding recess in a pack. One arm is provided with a substantially flat collet jaw and the other arm is provided with a counter member for cooperating with the collet. The collet ejects an item from the recess toward the counter member.

In one embodiment, one arm of the instrument is preferably arranged substantially stationary, whereas the other arm is temporarily movable toward the first arm. According to another embodiment, both arms operate in scissor fashion.

According to yet another embodiment of the invention, the instrument comprises two cooperating arms, with one arm having a protruding, substantially flat faced collet jaw and the other arm having a counter member. The collet jaw is arranged to protrude into the counter member when the arms of the instrument are squeezed together. The counter member includes means, such as a receptacle or even a through hole, for receiving an item which has been pressed from the recess in the support card. The counter member may be substantially annular for defining an opening which faces toward the collet moving toward it. That opening may also be shaped for receiving the collet within it and for receiving the expelled item. The opening in the counter member may be formed by an annular flange which defines the opening. The counter member may be separably attached to the arm for enabling its replacement. In fact, a plurality of counter members may be provided, each with different respective openings adapted to different shape items and collets. The counter member may be installed on its arm by the arm passing through the counter member. The arm may define the bottoms of the item receptacles in the counter member.

Other objects and features of the invention are described in the following text, which describes two embodiments shown in the accompanying drawings.

DESCRIPTION OF THE PREFERRED EMBODIMENTS

Figure 1:
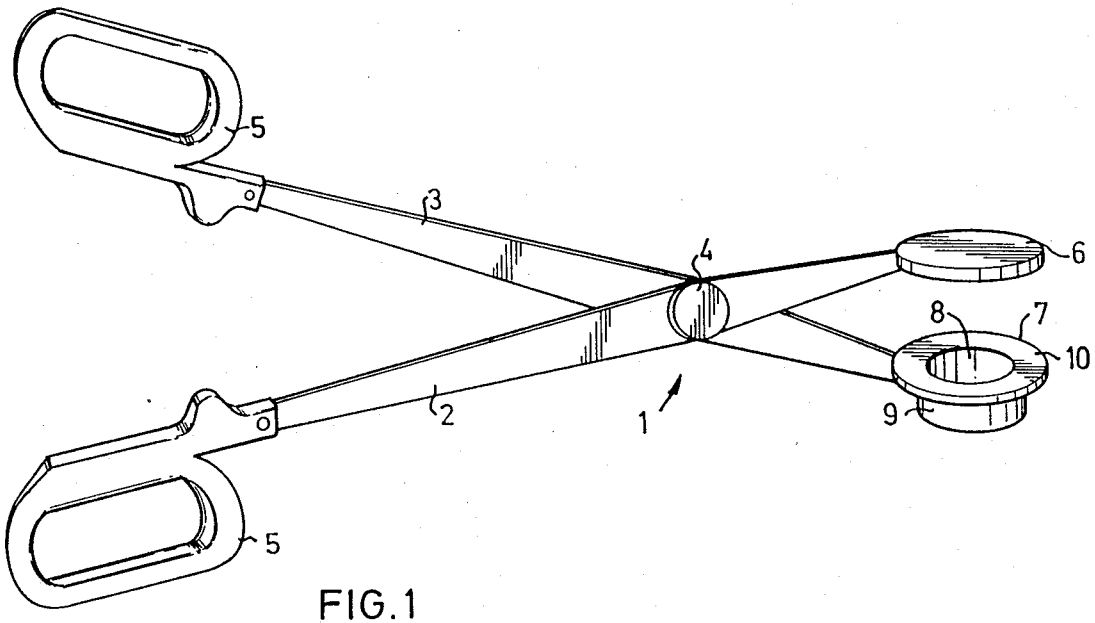
FIG. 1 is a perspective view of a first embodiment of an instrument according to the invention.

The instrument 1 shown in FIG. 1 comprises two arms 2, 3, joined at a location along the arms between their opposite ends, at a pivot hinge 4 so that the arms operate in scissor fashion. At one end of each arm 2, 3 is a respective handle 5. The other end of the arm 2 has a substantially flat collet jaw 6, which is preferably in the form of a plate and projects toward the arm 3. The corresponding other end of the arm 3 has an annular counter member 7, with a central aperture 8. Below the aperture 8 is a receptacle 9. The counter member 7 may comprise a replaceable, flanged insert 10.

For instance, with a card of tablets, not shown, the instrument 1 is applied by placing the collet jaw 6 against a recess in the card containing a tablet and by placing the counter member 7 facing the foil side of the card, i.e. in the intended direction of expulsion of the tablet from the recess. The arms 2 and 3 are then pressed together, forcing the collet jaw 6 towards the counter member 7 so that a tablet is pressed out of the recess of the card, through the aperture 8 and into the receptacle 9. The arms 2 and 3 are then opened and the receptacle 9 is inverted so that the tablet falls out into a hand, or the like, held below the receptacle. Alternatively, the receptacle 9 behind the aperture 8 may be omitted. The tablet then falls directly into a hand held below the instrument as the arms 2 and 3 are pressed together. To facilitate expulsion of tablets of different sizes held in recesses of different cards, the annular counter member 7 may be provided with a screw-thread or the like to enable substitution of a replaceable, flanged insert 10. Different inserts 10 may have different flange widths and/or hole diameters and the shape of the hole may also be varied, allowing the instrument to be adjusted to different packages and shapes of tablets.

The instrument 1 is preferably manufactured of metal or plastic. The handles 5 may be made exchangeable for different hand sizes. The pivot hinge 4 may also be openable for adjustment for right or left-handed people. The instrument can also be used for other purposes. For example, a counter member without an aperture can be used if the tablets are to be crushed.

Figure 2:
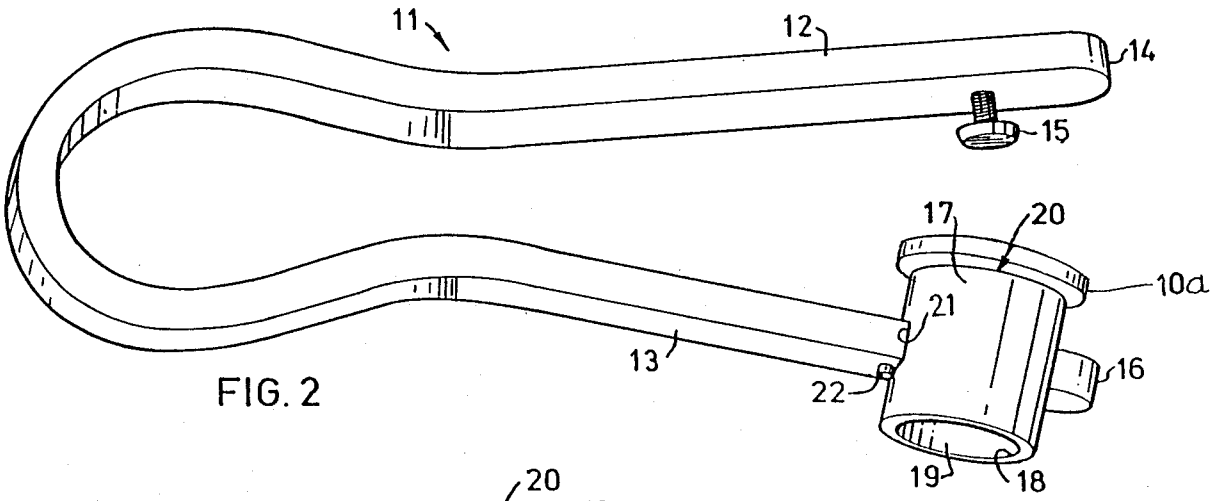
FIG. 2 is a perspective view of a second embodiment of an according to the invention.
Figure 3:
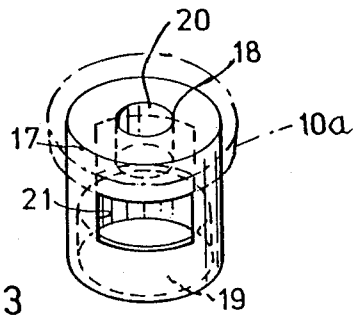
FIG. 3 shows in perspective a part of the instrument according to FIG. 2.

The embodiment of instrument 11 shown in FIGS. 2 and 3 comprises two arms 12 and 13 held together by a resilient bent length of material at one of the ends of both arms. A substantially flat collet jaw 15 protrudes from the inward side of the end 14 of one arm 12 toward the corresponding end of the other arm 13. A preferably detachable counter member 17 is attached at the end 16 of the other arm 13 to face toward the collet jaw 15. The counter member 17 comprises a cylindrical body with a central aperture 18 extending axially through the body. The diameter of the aperture 18 differs at the two ends of the cylindrical body, thus providing two different size receptacles 19 and 20. A recess 21 is provided in the axial center of the cylindrical body. The recess 21 is shaped to allow the cylindrical body to be fitted on to the arm 13 and up to a shoulder or a pin 22 on the arm 13.

The counter member 17 may have an annular flange 10*a*, corresponding to the flange 10 in the embodiment of FIG. 1.

The two arms 12 and 13 in FIG. 2 are preferably combined into one piece, made from a strip of resilient plastic material bent so that the two free arms 12 and 13 can be pressed together against the normal spring action of the integral unit (similar to an open hairpin, for instance).

The protruding collet jaw 15 may comprise a metal screw with a flat head, which is screwed into the side of the arm 12. The collet jaw 15 can thus be adjusted to project a suitable distance from the arm 12. The collet jaw 15 may, of course, be made of a different material and/or may be included as a fixed unit in the arm 12.

The counter member 17 may be integrated into the arm 13, which is then provided with a through-hole which can be varied in size with the aid of an insert. However, the counter member 17 preferably comprises the illustrated detachable cylindrical body which may be of plastic or other suitable material. The counter member 17 is preferably made of transparent material. The shoulder or pin 22 may be integrated with the arm 13 or may be in the form of a loose part of metal or plastic which is secured to the upper or lower side of the arm 13.

The instrument 11 shown in FIGS. 2 and 3 is applied with the collet jaw 15 against the closed bottom of a recess containing a tablet, for instance, on a card of tablets, and with the counter member 17 against the opposite foil side of the card, i.e. at the intended side of expulsion of the tablet. The arms 12 and 13 are then pressed together so that the collet jaw 15 is moved towards the counter member 17, which presses a tablet out of the package, down through the end of the aperture 18 then facing the jaw 15 and into the respective receptacle 19 or 20 then facing the jaw 15. In the embodiment shown, the arm 13 functions as the bottom for both receptacles 19 and 20 when the counter member 17 is fitted on the arm. After tablet expulsion, the instrument 11 is opened and inverted so that the tablet falls out of the receptacle 19 or 20 into a hand, or the like, held below the instrument 11. Alternatively, after tablet expulsion, the counter member 17 still holding the tablet may be removed from the arm 13 of the instrument 11, and the tablet falls into a hand held below the counter member 17 or onto a table or similar surface. After that, the counter member 17 and the tablet are swept over the edge of the table to be caught in the hand below.

To facilitate expulsion of different sized tablets, the aperture 18 may have different diameters at each axial end of the counter member 17. Naturally, the counter member 17 may also be exchangeable with different counter members 17 having different widths and hole diameters. Even the shape of the aperture may be varied. This enables the instrument 11 to be adapted to different packs of differently shaped medicaments.

The counter member 17 may also have a shape other than cylindrical. It might, for instance, be shaped as a cube with several through-holes 18 of different shape or diameter. In such embodiment also, the arm 13 may alternatively serve as the bottom of each receptacle. In the embodiment shown in FIGS. 2 and 3 the arm 13 functions as the bottom for both receptacles 19 and 20 when the counter member 17 is arranged on the instrument 11.

The aperture 18 need not be a through-hole. Instead, each receptacle 19 and 20 may have a bottom. In that case, the counter member 17 must be inverted to remove the expelled tablet. The counter member 17 may alternatively serve as a dosing beaker after its removal from the arm.

The embodiment in FIGS. 2 and 3 allows the instrument 11 to be placed on a table or similar surface, with the part joining the arms 12 and 13 and one end of the counter member 17 in contact with the table. The card of tablets can then be held with one hand while the instrument is operated with the other hand, an elbow or another part of the body. This is particularly suitable for an elderly or handicapped person. To prevent the counter member 17 from becoming detached, the arm 13 may in this case extend past the counter member 17, or it may be provided with a locking means outside the counter member 17 along the arm 13 to position or ensure correct placement of the counter member 17 on the limb 13. A ball with spring action may be located at the end of the arm 13, or the outermost end of the arm 13 may be arranged pivotable 90° with respect to the length of the arm, to retain the counter member 17.

Of course, the instrument 1 can also be held and operated in one hand, with the other hand holding the card of tablets.

According to another embodiment of the invention, not shown in detail in the drawings, one end of the instrument may be stationary and rigid. Only one arm can then be moved.

In order to increase the applications of the instrument to other types of articles (bottles with screw tops, plastic lids without screw-threads), the protruding collet jaw 15 on arm 12 and the stop or pin 22 on arm 13 may be designed to grip and position a screw lid placed between the arms 12 and 13. The detachable counter member 17 would not in this case be placed on the arm 13. Opening of the screw-top is facilitated by pressing the arms 12 and 13 together and then twisting the instrument 11 and the bottle with its screw-top in opposite directions. This can be further facilitated by providing the opposing parts of the arms 12 and 13 with corrugations.

To facilitate opening plastic lids that seal packs of pharmaceuticals, and the like, that are not provided with screw-threads, the top of the arm 12 may be provided with a protruding point enabling it, together with the arm 12, to be used in the same manner as a bottle-opener.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. An instrument for pressing an object out of a receptacle defined in a support, wherein the support includes at least one recess, the recess has an open top and the open top is closed by a covering layer of burstable material;

the instrument comprising;

a pair of arms supported to each other, which can be moved together, the first arm supporting a collet which projects from the first arm toward the second arm, and the second arm supporting a counter member facing toward the collet on the first arm, the counter member being shaped and positioned for cooperating with the collet on the first arm when the arms are moved together, whereby when the collet is placed against the side of the support at a closed side of the recess, the counter member is placed at the covering layer over the open side of the recess such that moving the arms together presses the collet against the closed side of the recess to force the article to burst through the covering layer toward the counter member;

the counter member is substantially annular with an open region at the center positioned to receive the collet when the first and second arms are moved together; the counter member further including a receptacle adjoining the annular portion thereof for receiving an item pressed from the recess;

the second arm extending through the counter member and defining a bottom for the receptacle in the counter member.

2. An instrument for pressing an object out of a receptacle defined in a support, wherein the support includes at least one recess, the recess has an open top and the open top is closed by a covering layer of burstable materials;

the instrument comprising;

a pair of arms supported to each other, which can be moved together, the first arm supporting a collet which projects from the first arm toward the second arm, and the second arm supporting a counter member facing toward the collet on the first arm, the counter member being shaped and positioned for cooperating with the collet on the first arm when the arms are moved together;

whereby when the collet is placed against the side of the support at a closed side of the recess, the counter member is placed at the covering layer over the open side of the recess such that moving the arms together presses the collet against the closed side of the recess to force the article to burst through the covering layer toward the counter member;

the counter member having an opening therein which is shaped and positioned for receiving the collet of the first arm, whereby an item pressed out of the recess in the support will move into that opening;

the counter member having differently facing sides, each with a respective opening therein, the openings being defined on opposite sides of the counter member and the counter member being supportable on the second arm at respective orientations for enabling a selected one of the openings to face toward and receive the collet;

the counter member being shaped so that the second arm passes through the counter member and defines a bottom for each of the openings in the counter member for forming each of the openings as a respective receptacle.

* * * * *